US006441285B1

(12) United States Patent
Kurosaki

(10) Patent No.: US 6,441,285 B1
(45) Date of Patent: Aug. 27, 2002

(54) DRUM

(75) Inventor: Makoto Kurosaki, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 0 days.

(21) Appl. No.: 09/651,758

(22) Filed: Aug. 30, 2000

(30) Foreign Application Priority Data

Aug. 31, 1999 (JP) ..... 11-244466

(51) Int. Cl.[7] ..... G10D 13/02
(52) U.S. Cl. ..... 84/411 R; 84/412
(58) Field of Search ..... 84/411 R, 412; D17/99

(56) References Cited

U.S. PATENT DOCUMENTS 3,643,710 A * 2/1972 Fitzgibbon ..... 144/3 R
5,171,616 A * 12/1992 Dejima ..... 428/22
5,587,544 A * 12/1996 Fujii et al. ..... 84/411 R
5,895,873 A * 4/1999 Yanagisawa ..... 84/415
5,981,858 A * 11/1999 Jeng ..... 84/411 R
6,051,764 A * 4/2000 Sakurai ..... 84/291

FOREIGN PATENT DOCUMENTS

| | | |
|---|---|---|
| JP | S53-47939 | 11/1978 |
| JP | H8-30266 | 2/1996 |
| JP | H8-030266 | 2/1996 |
| JP | H11-045087 | 2/1999 |

* cited by examiner

*Primary Examiner*—Robert E. Nappi
*Assistant Examiner*—Kim Lockett
(74) *Attorney, Agent, or Firm*—Koda & Androlia

(57) ABSTRACT

A drum body made of bamboo. A joined board is obtained by joining a plurality of rectangular bamboo elements, which are cut out of bamboo stem, so that the top surfaces and undersurfaces of these bamboo elements are alternately inverted. A laminated board is manufactured by stacking and bonding a plurality of these joined boards, and this laminated board is rolled into a cylindrical shape so as to form the drum body with its both ends opened.

7 Claims, 8 Drawing Sheets

DRUM

BACKGROUND OF THE INVENTION

1. Field of the Invention

The present invention relates to a drum such as a bass drum, snare drum, marching drum and the like, and more particularly to a drum body of such drums.

2. Prior Art

The drum body of a drum causes the percussive sound to resonate. It also functions as a reinforcing member that supports the drumheads and snappies. Accordingly, the body of a drum must maintain its shape in a stable fashion, and it should not deform as a result of meteorological conditions or tension on the drumheads. Drum bodies must show little deviation in tuning and should not show any auto-vibration or auto-absorption. Such drum bodies are manufactured by wood, metals such as aluminum, FRPs (fiber-reinforced plastics), etc. However, drum bodies made of metals or synthetic resins cannot produce a sound that has warmth in terms of tone quality. Thus, most of drum bodies are made of wood.

Wood materials that have an appropriate hardness and are superior in terms of acoustic characteristics are, for instance, maples, birches and beeches; and they are used as wood materials for drum bodies. When wood materials are used, thin, uniform single boards are obtained using rotary lathe; and a laminated board formed by stacking and bonding a plurality of these single boards is employed as the drum body.

Conventional drums are, as seen from the above, manufactured using wood materials that have suitable acoustic characteristics such as maples, birches and beeches. However, such wood materials have problems. As resources have dwindled due to the harvesting of forests, such wood materials are now expensive and difficult to obtain. Therefore, the use of relatively inexpensive tropical materials (lauan, shina, etc.) is recently studied. However, since such tropical materials are mainly used for construction, the dwindling of resources due to large-scale harvesting has progressed rapidly. Thus, like the above-described woods such as maples, birches and beeches, it is difficult to obtain a stable supply of such relatively inexpensive tropical materials.

Furthermore, when the above-described wood materials are used for drum bodies, a plurality of thin unit boards are formed by rotary lathe; and such thin boards are stacked and subjected to press working to form laminated boards. However, splits likely to occur in the undersurfaces (the surfaces closer to the center of the wood) of the respective unit boards. Thus, it is difficult to obtain uniform laminated boards for drum bodies.

Moreover, since wood contains many knots, wood materials lack homogeneity, and the yield is low. In addition, the acoustic characteristics differ slightly in each manufactured product.

SUMMARY OF THE INVENTION

Accordingly, the object of the present invention is to solve the above problems with the conventional drum bodies.

The main object of the present invention is to provide a novel drum that uses materials which are inexpensive and can be obtained easily and constantly.

In order to accomplish the object, in the present invention, the drum body on which the drumheads are stretched is made of bamboo.

More specifically, in the present invention, a bamboo material is obtained from a laminated board that is formed by joined bamboo boards. In each of the joined bamboo boards, a plurality of bamboo elements of a rectangular shape are joined in the direction of width thereof with the top surfaces and undersurfaces of the bamboo elements alternately inverted.

Bamboo is less expensive than wood materials such as spruce, etc. Bamboo grows more quickly than common woods and is not used very widely as a construction material. Accordingly, bamboo is an easily obtainable material.

Furthermore, bamboo has a dense aggregation of long, slender fibers. These fibers extend uniformly in the direction of length of bamboo and have a high rigidity. Accordingly, by employing different connections and joints of bamboo elements, it is possible to use bamboo as a material that is suitable for drum bodies. Since bamboo has a few joints, it is superior in terms of homogeneity.

The acoustic characteristics of bamboo differ from those of ordinary wood materials. In other words, the sound propagation velocity along the direction of the fibers of bamboo is higher than the sound propagation velocity of ordinary wood materials, while the sound propagation velocity in the direction perpendicular to the direction of the fibers of bamboo is slower than the sound propagation velocity of ordinary wood materials.

A laminated board obtained by stacking and bonding a plurality of joined boards (single boards) formed by joining bamboo elements with the top surfaces and undersurfaces of the bamboo elements alternately inverted shows little warping or splitting due to changes in temperature. Thus, the use of bamboo for a drum body as in the present invention is highly advantageous.

DETAILED DESCRIPTION OF THE PREFERRED EMBODIMENTS

The present invention will be described below in detail based upon the embodiments shown in the accompanying drawings.

Figure 1:
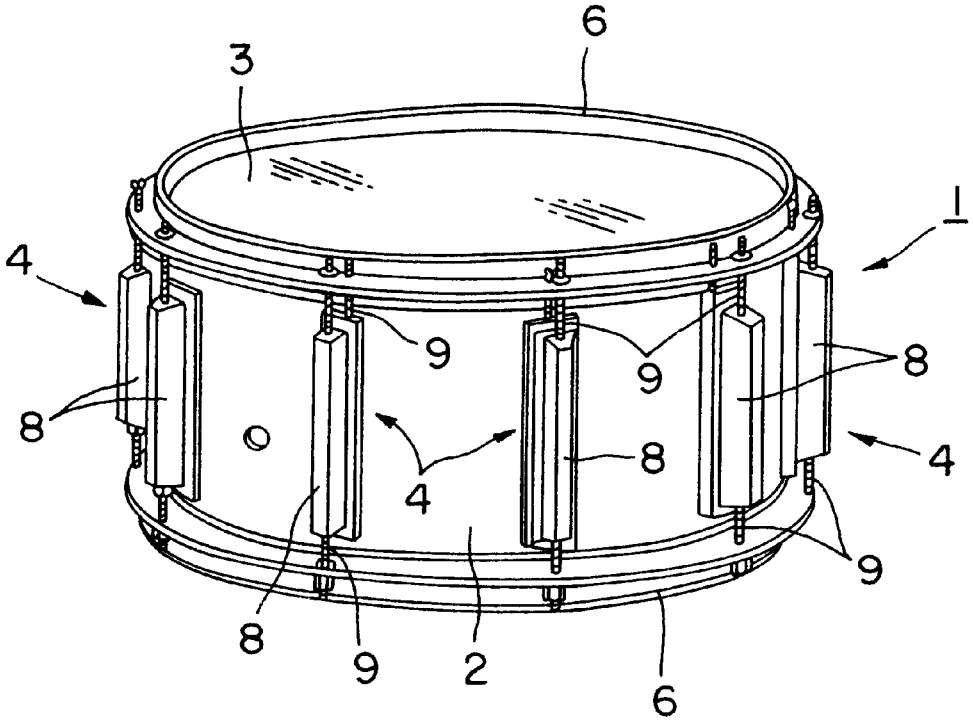
FIG. 1 is a perspective view of one embodiment of the drum according to the present invention.

FIG. 1 is an external perspective view of an embodiment in which the present invention is applied to a snare drum.

In FIG. 1, the drum 1 comprises a drum body 2, two drumheads 3 (only one shown), and a plurality of head supporting and tensioning means 4 along with other components. The drum body 2 is in the shape of a cylinder that is open at both ends, and the drumheads 3 are stretched so that they cover the respective openings of the drum body 2. The drumheads 3 are animal (or natural) skins or a synthetic resin film, such as a polyester resin, polycarbonate resin film. The plurality of the head-supporting tensioning means 4 are provided on the drum body 2 so as to support and stretch the drumheads 3.

The head-supporting tensioning means 4 include annular head frames (not shown) which hold the circumferential edges of the drunheads 3 and are fitted over the outer circumferences of the open-end portions of the drum body 2. The head-supporting tensioning means 4 further include, along with other components, annular tightening frames (rims) 6 which are likewise fitted over the outer circumference of the drum body 2 and press against the head frames, lugs 8 which are fastened to the outer circumferential surface of the drum body 2, and tightening bolts 9. When the tightening bolts 9 are rotated, the rims 6 shift in the axial direction of the drum body 2, and the pressing force applied to the head frames 3 by the rims 6 is changed. As a result, the tension of the drumheads 3, in other words, the tone color of the drum, is adjusted.

The drum described above differs from conventional drums in that the drum body 2 is manufactured from a laminated board whose base material is bamboo, which belongs to the grass family. All other aspects including the construction, shape, etc. are substantially the same as those of non-bamboo conventional drums.

The method for manufacturing the bamboo material (or bamboo body board) that serves as the base material of the drum body 2 will be described below.

Figure 2A:
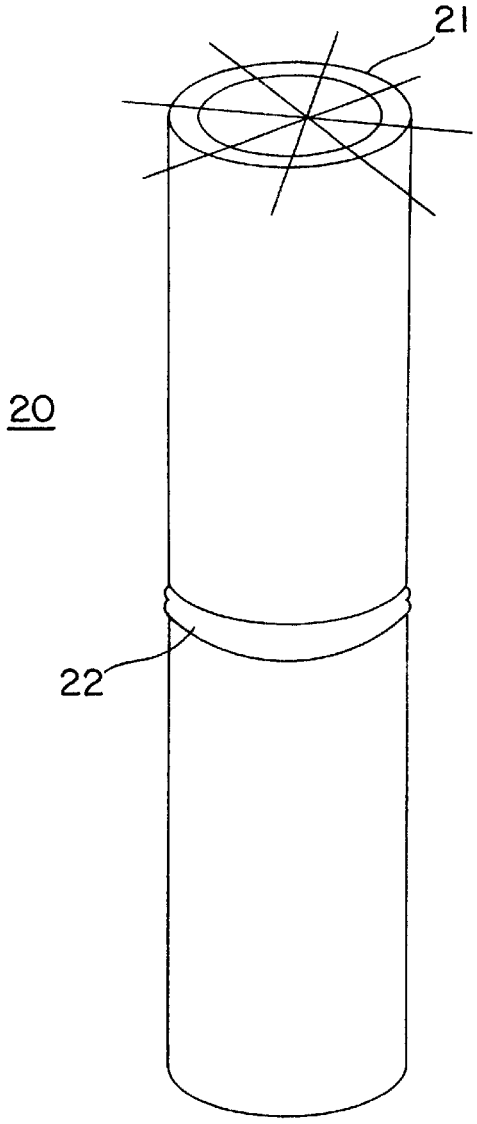
FIG. 2(*a*) shows a stalk of bamboo, and FIG. 2(*b*) is a diagram which shows one of the bamboo elements obtained from a cutout piece of bamboo.
Figure 2B:
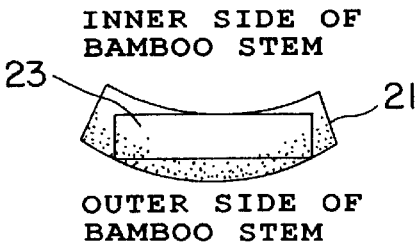

In FIG. 2(*a*), the reference numeral 20 refers to bamboo or a bamboo stem, the reference numeral 21 refers to an arc-shaped piece of the bamboo 20, and the reference numeral 22 refers to a joint in the bamboo 20. FIG. 2(*b*) shows a bamboo element 23 obtained from the bamboo of FIG. 2(*a*).

First, the bamboo 20 is split into arc-shaped bamboo pieces 21, and a rectangular or elongated bamboo element 23 is obtained from the arc-shaped bamboo piece 21 by way of cutting a single bamboo piece 21 as shown in FIG. 2(*b*).

The bamboo 20 is a Japanese bamboo that belongs to the genus mosochiku. However, since bamboo is produced in Asia, Africa, North and South America, and other places, those produced in these areas can be also used. Generally, bamboo includes an aboveground stalk and an underground stalk. It is preferable to use aboveground stalk, which is straight and has a long interval between joints. In selecting the bamboo 20 to be used, it is necessary to pick bamboo which is of a suitable age (plant age) and has uniform color with no staining, soiling, scratches, etc.

The selected bamboo 20 is cut into an appropriate length, and the cut bamboo 20 is split around the circumference, thus obtaining a plurality of arc-shaped bamboo pieces 21. FIG. 2(*a*) shows an example in which the bamboo 20 is split into eight equal pieces. However, the present invention is not limited to this. Depending on the diameter, the bamboo 20 can be split into fewer than eight pieces or more than eight pieces. The arc-shaped bamboo pieces 21 are thereafter worked into long, slender flat-plate-form (rectangular) bamboo elements 23. If the joints 22 are present in the bamboo element 23, such joints are worked to be flat.

Figure 3A:
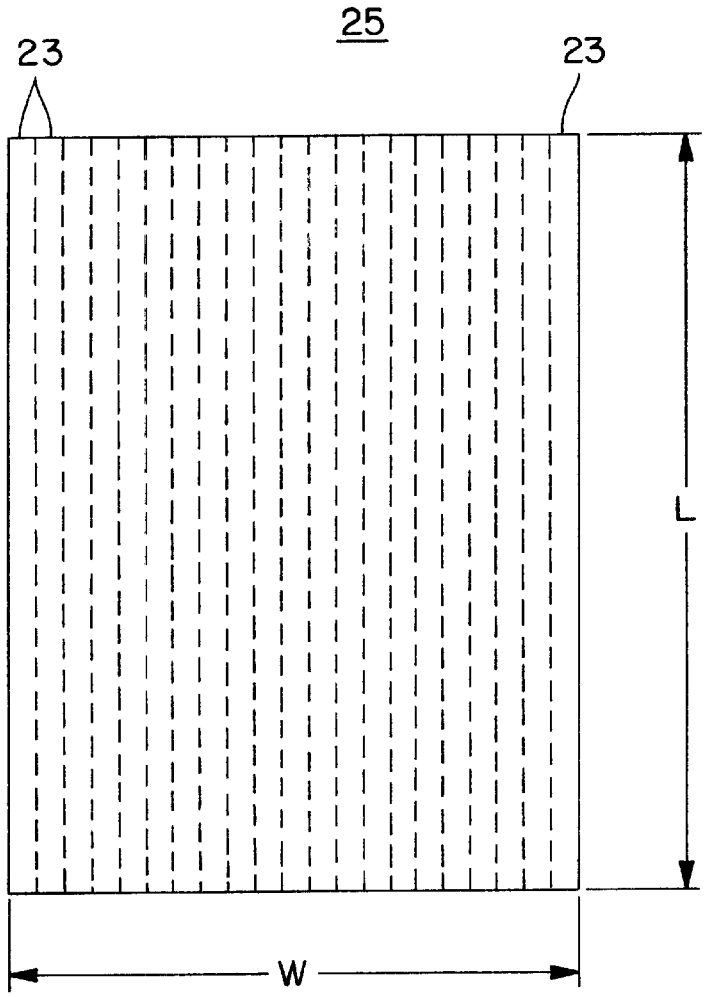
FIGS. 3(*a*), 3(*b*) and 3(*c*) are, respectively, a front view of the joined board material, a bottom view thereof, and an enlarged sectional view of a part of the joined board.
Figure 3B:
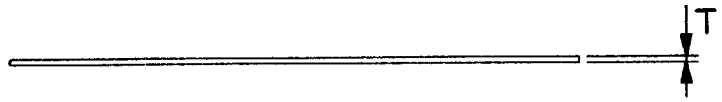
Figure 3C:
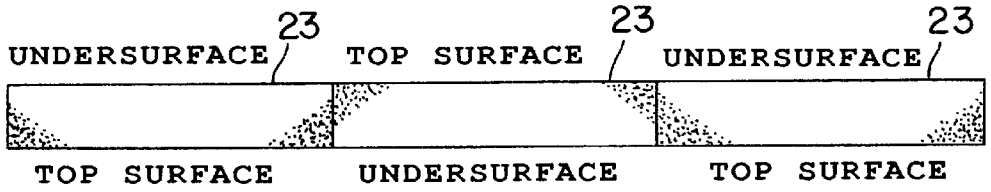

FIGS. 3(*a*), 3(*b*) and 3(*c*) show the joined board material obtained by a plurality of bamboo elements 23.

The reference numeral 25 refers to a joined board material, which is a single board. This joined board material 25 is obtained by joining a plurality of rectangular bamboo elements 23 side by side or in the direction of width thereof into a rectangular shape as seen from FIG. 3(*a*). The top surfaces (or the outer side of bamboo stem) and undersurfaces (or the inner side of bamboo stem) of the bamboo elements 23 are alternately inverted as shown in FIG. 3(*c*). The reason for joining the bamboo elements 23 with the top surfaces and undersurfaces alternately inverted is to prevent warping that would be caused by, for instance, temperature changes. In selecting the bamboo elements 23, those having a suitable age and uniformed color and which are free of any staining, soiling, scratches, etc. are selected. The size of joined board 25 varies according to the size (height and diameter) of the drum body 2 that is to be produced. For instance, in the case of a snare drum, the joined board material 25 has the length L of approximately 1200 mm, the width W of approximately 350 mm, and the thickness T of approximately 1 to 2 mm.

The bamboo elements 23 are joined and bonded side by side with no gaps in between. Joining is not performed in the longitudinal direction or in the direction of length L (the longitudinal direction is ordinarily called a "connection"). Afterward joining, the joined board 25 is cut into a specified size in accordance with the size of the drum body 2, and a laminated board is obtained.

Figure 4:
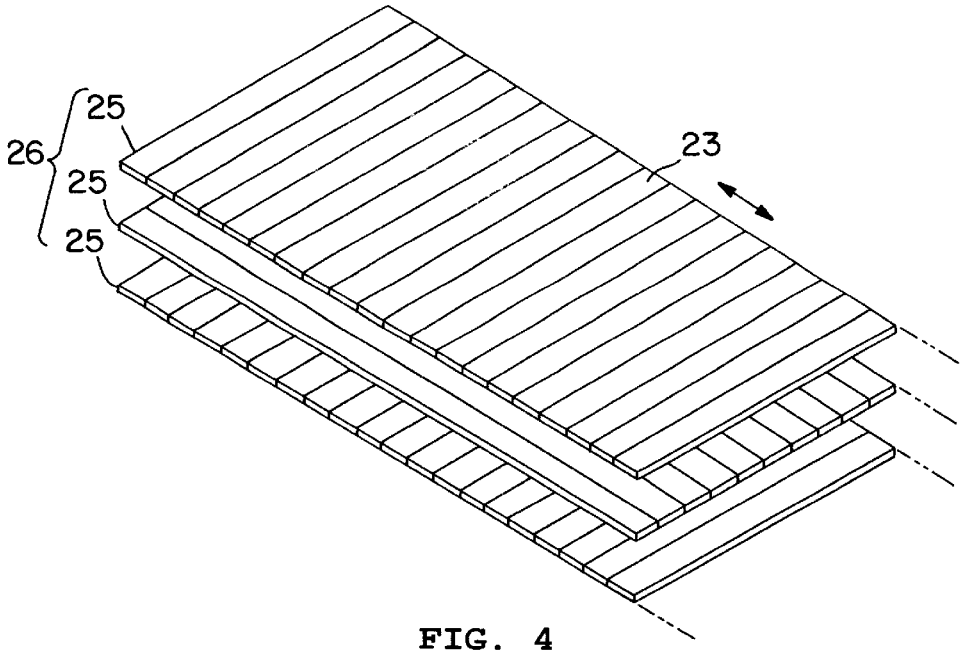
FIG. 4 llustrates the laminated board used in the present invention.

FIG. 4 shows a three-ply laminated board 26. This laminated board 26 is formed by stacking and bonding three joined boards 25 after cutting them into a specified size. When stacking, the joined boards 25 are put on the other so that the direction of bamboo fibers, which that extend in the direction of the length of stalk of bamboo (or in the direction of L of FIG. 3(*a*)), of the joined boards 25 are set at right angles. More specifically, the bamboo fiber direction of the top and bottom joined boards 25 are set in the same direction, and the bamboo fiber direction of the middle joined board 25 is set to be at right angles relative to that of the top and bottom joined boards 25. The thus set joined boards 25 are pressed and joined together by an adhesive agent. Since the bamboo is sliced into thin, long and slender flat-plate-form bamboo elements 23, splitting would not occur in pressing.

Figure 5A:
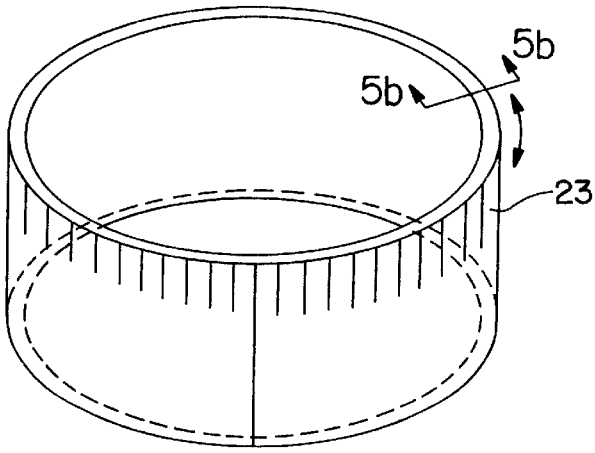
FIG. 5(*a*) illustrates a drum body obtained from the laminated board shown in FIG. 4, and FIG. 5(*b*) shows the shape of the edge portion of the drum body of FIG. 5(*a*) as viewed in the direction 5*b*–5*b* in FIG. 5(*a*)
Figure 5B:
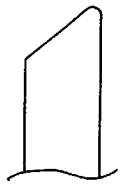

Then, the edge portions on the long sides of the laminated board 26 are worked into pointed edges. This is shown in FIG. 5(*b*). This pointed edge formation is done so as to clearly define the supporting edges for the drumheads 3.

In the preparation of the laminated board 26, the present invention is not limited to such a laminated board that uses only the joined boards 25 of bamboo. For instance, a single board or a laminated board made of wood other than bamboo can be used in combination with a laminated bamboo board 26. For instance, a single board or laminated boards made of wood are inserted as a core between two bamboo joined boards 25, and then these non-bamboo and bamboo boards are stacked and bonded together. Or, a bamboo joined board 25 is used as a core board between two single boards or two laminated boards made of wood, and then these bamboo and non-bamboo boards are stacked and bonded together.

The laminated board 26 obtained as described above is rolled up into a cylinder as shown in FIG. 5(*a*), and the end portions of the laminated board 26 are bonded to each other, thus forming a drum body 2 of a desired size.

In FIG. 5(*a*), the drum body 2 is formed so that the direction of joining of the bamboo elements 23 (i. e., the direction shown by arrow) is in the circumferential direction on the outer surface side of the drum body 2. In other words, the bamboo fibers are set in the circumferential direction on the outer surface of the drum body 2, so that the bamboo fibers appearing on the outer surface of the drum body 2 are in the same direction as the axis of the drum body 2. Reversely, the direction of the bamboo fibers of the bamboo elements 23 can be set in the direction of diameter on the outer surface of the drum body 2, so that the bamboo fibers appearing on the outer surface of the drum body 2 are at right angles with reference to the axis of the drum body 2.

Figure 6A:
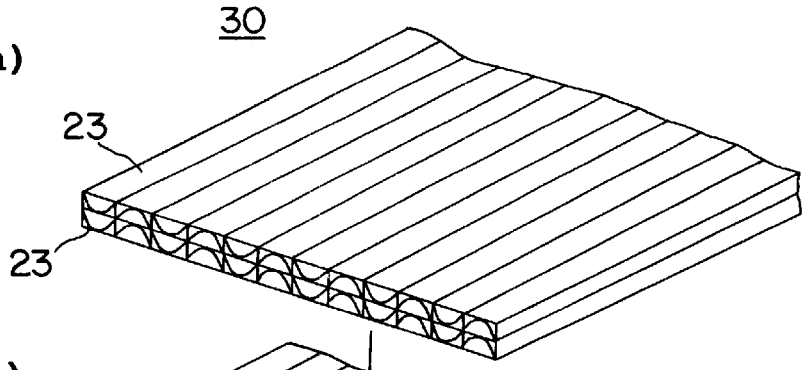
FIGS. 6(*a*), 6(*b*) and 6(*c*) illustrate a method for manufacturing the joined board according to the present invention.
Figure 6B:
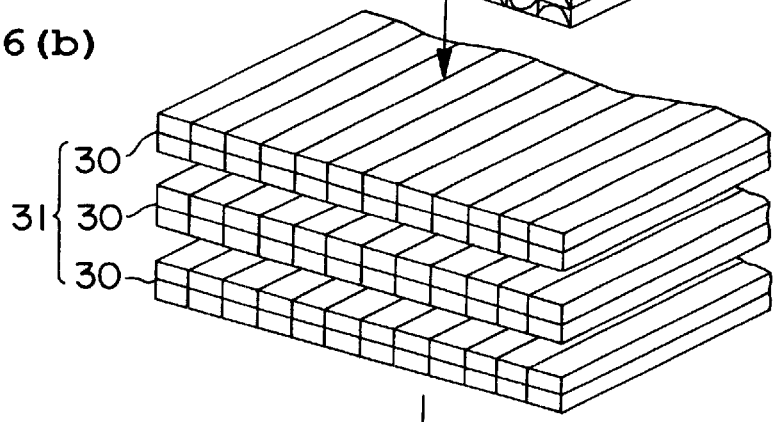
Figure 6C:
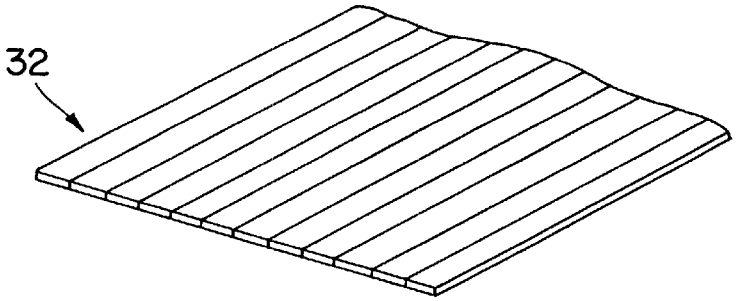

FIGS. 6(*a*), 6(*b*) and 6(*c*) illustrate another type of the joined board.

The laminated joined board 30 is obtained by laminating and joining bamboo elements 23 in two layers as shown in FIG. 6(*a*). Such a joined board 30 may be formed by laminating and joining two of the joined boards 25 shown in FIGS. 3(*a*)–3(*c*).

An aggregate material 31 is formed by stacking and joining a plurality of these laminated joined boards 30 as shown in FIG. 6(*b*). Then, this aggregate material 31 is sliced to a thickness of approximately 0.5 to 2 mm so as to form a drum body board 32 as shown in FIG. 6(*c*).

Figure 7:
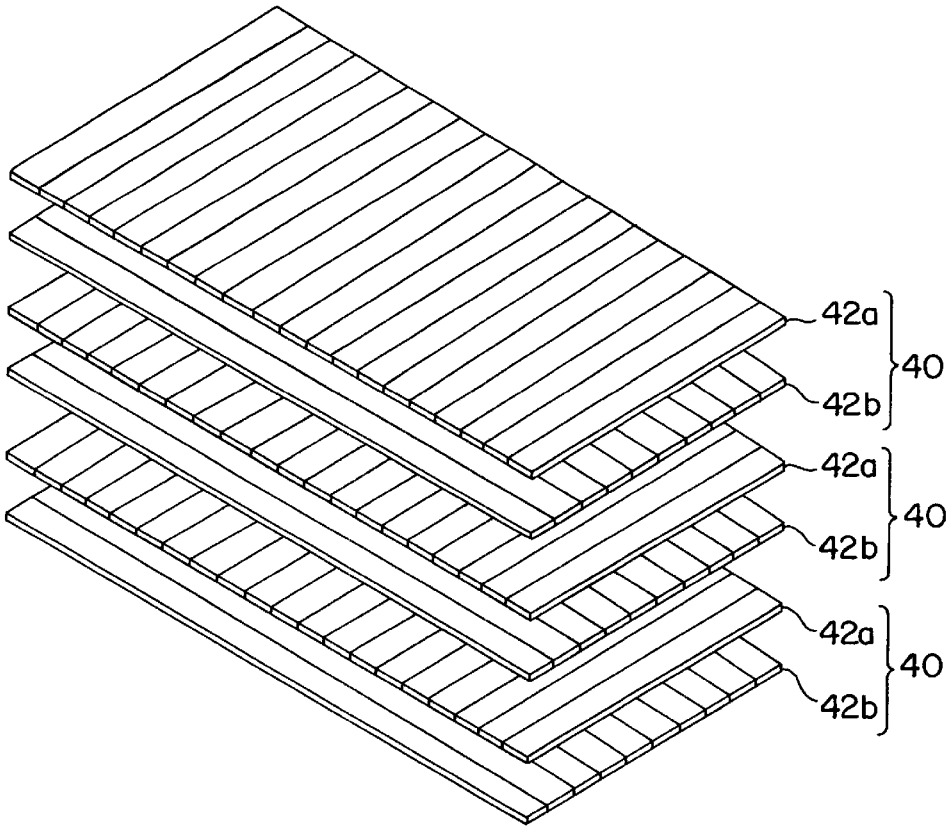
FIGS. 7 and 8 illustrate other methods of manufacturing the laminated boards according to the present invention.
Figure 8:
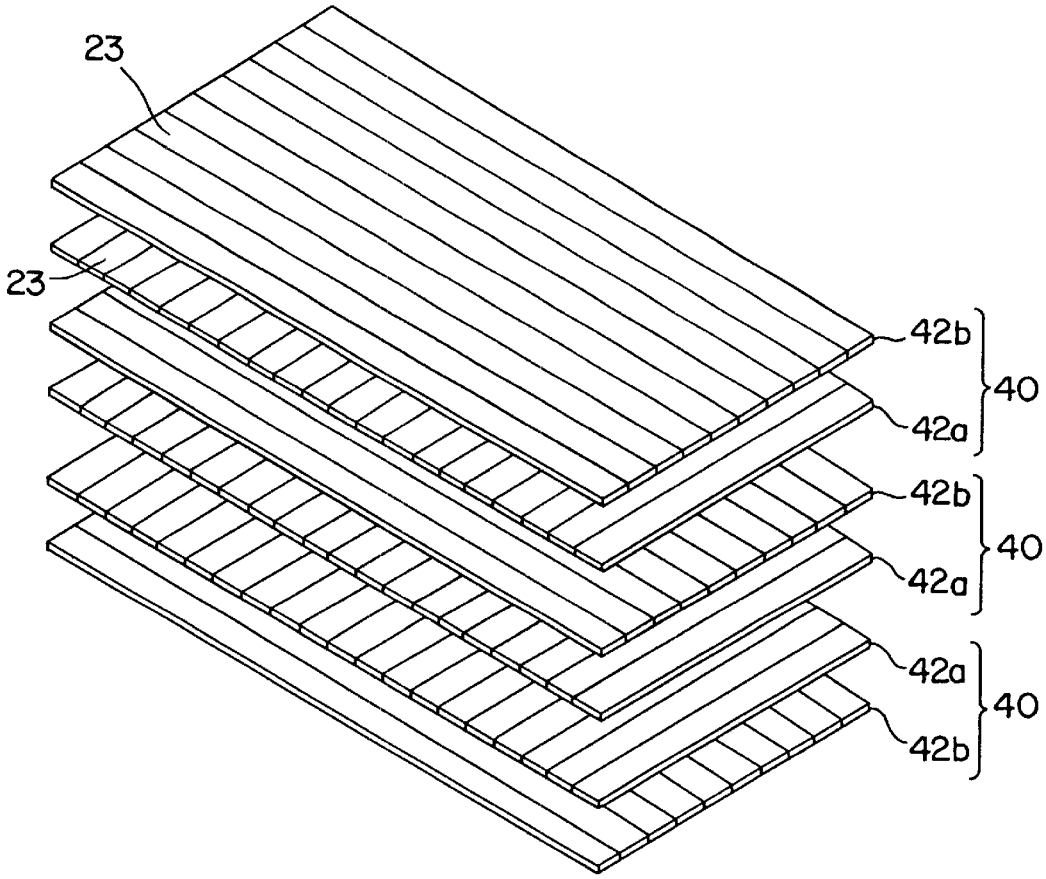

FIGS. 7 and 8 show still further embodiments of the present invention. In these embodiments, three pairs of laminated boards 40 are employed.

More specifically, in these embodiments, each of the laminated boards 40 is obtained by stacking and bonding two, upper and lower, bamboo joined boards 42*a* and 42*b* with the bamboo fiber directions of the joined boards 42*a* and 42*b* set to be at right angles; and three of these laminated boards 40 are put on the other and joined into a single rectangular drum body board by an adhesive agent.

In the embodiment of FIG. 7, the bamboo fibers of the upper joined boards 42*a* of the laminated boards 40 are set in the same direction, and the bamboo fibers of the lower joined boards 42*b* are in the same direction. Three (3) pairs of thus arranged laminated boards 40, each comprising the upper and lower joined boards 42*a* and 42*b* of which bamboo fibers are crossing at right angles are set in the same orientation.

In the embodiment of FIG. 8, one (the bottom one in the shown embodiment) of the three laminated boards 40 is set upside down with reference to the other two laminated boards 40. Thus, the fiber direction of only two (2) of the three pairs of laminated boards 40 is in the same orientation. In other words, in the drum body board of FIG. 8, the direction of bamboo fibers (or the direction of joining the bamboo elements 23) of the joined boards 42*b* that are positioned at both ends are set to be parallel to the longer sides of the rectangular drum body board.

Figure 9:
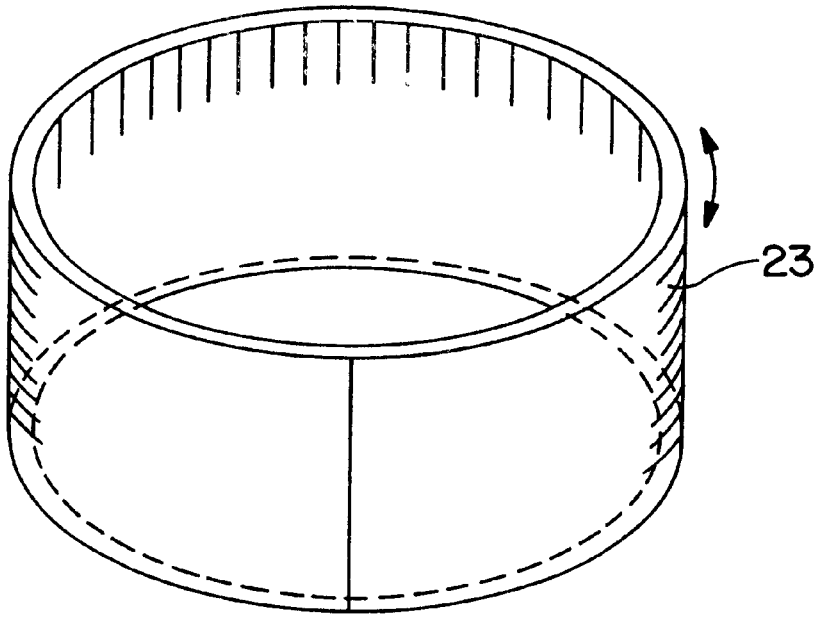
FIG. 9 illustrates a drum body obtained from the laminated board shown in FIG. 7.

FIG. 9 shows the drum body that uses the drum body boards shown FIG. 7. In this drum body 2, the drum body board is set so that the bamboo fibers appearing on the outer surface of the drum body 2 are at right angles with reference to the axis of the drum body 2, and the bamboo fibers on the inner surface of the drum body 2 are in the same direction as the axis of the drum body 2. Obviously, a drum body as shown in FIG. 5(*a*) can be obtained using the drum body board of FIG. 7 so that the bamboo fibers on the outer surface of the drum body 2 are in the same direction as the axis of the drum body 2, and the bamboo fibers on the inner surface of the drum body 2 are at right angles with reference to the axis of the drum body 2.

Figure 10:
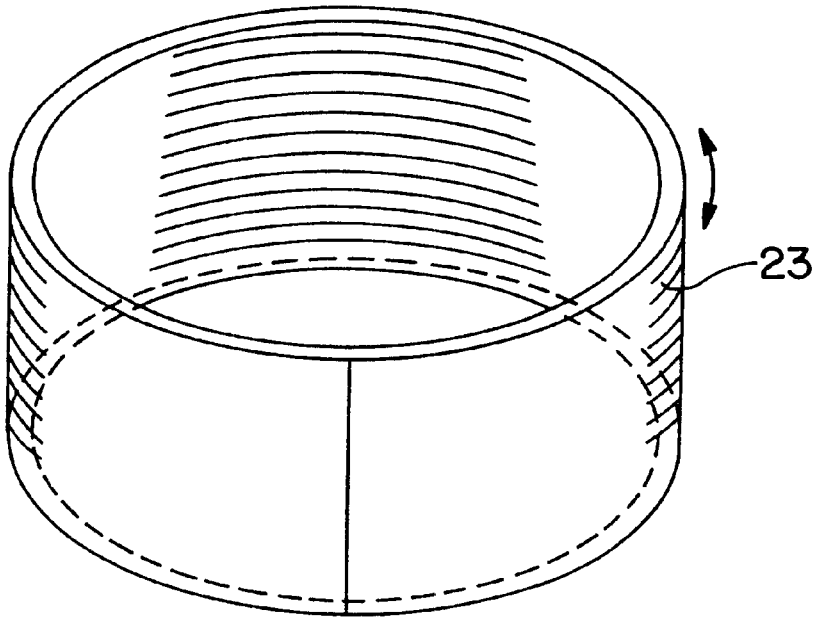
FIG. 10 illustrates a drum body obtained from the laminated board shown in FIG. 8.

FIG. 10 shows the drum body that uses the drum body boards shown FIG. 8. In this drum body 2, the drum body board is set so that the bamboo fibers on the outer surface of the drum body 2 are at right angles with reference to the axis of the drum body 2, and the bamboo fibers on the inner surface of the drum body 2 are also at right angles with reference to the axis of the drum body 2.

The joined boards 42*a* and 42*b* and the laminated boards 40 can be formed with the bamboo fibers set in any desired directions including the directions described above. Also, the directions of bamboo fibers on the outer and inner surfaces of the drum body can be selected in any desired directions including those described above.

In FIGS. 7 and 8, three pairs of laminated boards 40 each comprising two layers of joined boards 42*a* and 42*b* are used. However, six joined boards 42*a* and 42*b* can be joined so as to form a single laminated board or a drum body board with the direction of bamboo fibers of each joined boards set at right angles.

The respective tone colors of a drum having the bamboo drum body according to the present invention and a conventional drum made of wood were compared in the tests. Almost no difference was observed. Thus, it is ascertained that a drum made of bamboo as in the present invention provides adequate musical performance. Since bamboo has high rigidity compared to wood and is completely straight with a uniform texture, the bamboo drum can produce a constant tone color.

The sound propagation velocity along the direction of the fibers of bamboo is higher than the sound propagation velocity of ordinary wood. Also, the sound propagation velocity in the direction perpendicular to the fibers in bamboo is slower than the sound propagation velocity of ordinary wood. However, in the drum body manufactured by the laminated board in which the joined boards are stacked and bonded so that the fiber directions of the joined boards alternately cross each other, vibrations are rapidly transmitted throughout the drum body as a whole. Thus, phase discrepancies of the vibrations within the drum body are reduced, and higher harmonic modes of vibrations tend to attenuate, so that split vibrations are suppressed, thus producing a clearer sound.

In the embodiment of FIG. 4, the drum body 2 uses the three-layered laminated board 26. However, the present invention is not limited to this. It is possible to use a two-layered, four-layered laminated board, etc.

As seen from the above, in the drum of the present invention, the drum body is made of a laminated bamboo board. Accordingly, the cost of materials for drums can be greatly reduced compared to drum bodies manufactured using expensive woods such as maples, beeches, birches, etc., since the bamboo is inexpensive.

Furthermore, bamboo is an abundant resource; and unlike ordinary woods, bamboo can be grown in a few years. Accordingly, the material for drum bodies can be easily and stably obtained over the long term.

The laminated board used in the present invention is obtained by joined boards, and the top surfaces and undersurfaces of bamboo elements are alternately inverted. Accordingly, warping, splitting, etc. caused by temperature changes can be avoided.

In addition, bamboo is high in rigidity and is completely straight with a uniform texture. The drum body made of bamboo is thus favorable in acoustic terms and produces a stable tone color.

What is claimed is:

1. A drum wherein a drum body thereof is formed from a bamboo material, said drum body having a cylindrical shape that is open at both ends thereof, said bamboo material comprising a single laminated board formed into said cylindrical shape and said laminated board comprises a joined board in which a plurality of bamboo elements having a rectangular shape are joined in a direction of width thereof, and lengthwise direction of the bamboo elements of rectangular shape is either parallel or vertical with reference to a depth of the drum body.

2. The drum according to claim 1, wherein said joined board is obtained by joining a plurality of bamboo elements having rectangular shape with top surfaces and undersurfaces of said bamboo elements being alternately inverted.

3. The drum according to claim 1, wherein said laminated board comprises at least two joined boards, and directions of bamboo fibers of said at least two joined boards are set at right angles.

4. A drum wherein a drum body thereof is formed from a bamboo material having bamboo fibers provided in first direction and other bamboo fibers provided in a second direction different from said first direction.

5. The drum according to claim 4 therein said first and second directions are set at right angles to each other.

6. The drum according to claim 4 wherein one of said first and second directions is in a direction of a circumference of said drum body and the other is parallel to a direction of a depth of said drum body.

7. The drum according to claim 1, wherein a width and length of said laminated board respectively is substantially equal to a height and circumference of said drum body.

* * * * *